United States Patent [19]

Tarrant

[11] 4,056,943

[45] Nov. 8, 1977

[54] HULL CONSTRUCTION

[76] Inventor: D. Jarratt Tarrant, 12611 Rovensway Drive, Cypress, Tex. 77429

[21] Appl. No.: 653,767

[22] Filed: Jan. 30, 1976

[51] Int. Cl.[2] ..... E02D 21/00

[52] U.S. Cl. ..... 61/96; 61/91

[58] Field of Search ..... 61/46.5, 46, 91, 96, 61/86, 87, 90; 114/77 R, 77 A

[56] References Cited

U.S. PATENT DOCUMENTS

| | | | |
|---|---|---|---|
| 2,906,100 | 9/1959 | De Long et al. | 61/46.5 |
| 3,183,676 | 5/1965 | Le Tourneau | 61/46.5 |
| 3,466,878 | 9/1969 | Esquillan et al. | 61/46.5 |
| 3,999,396 | 12/1976 | Evans | 61/92 |

*Primary Examiner*—Jacob Shapiro
*Attorney, Agent, or Firm*—Donald Gunn

[57] ABSTRACT

The new and improved hull construction for a jack-up rig is disclosed. In the preferred embodiment, a three legged jack-up rig is disclosed. The rig is supported on three legs which extend through similar corner compartments having leg elevating equipment thereat. Along the three sides of the triangular hull, side compartments of similar rectangular and or trapezoidal construction are located which encompass or enclose a central triangular compartment. The side compartments are aligned in a strengthening direction. The main side compartments have a rectangular area and hence lend themselves readily to crew quarters, machinery rooms, and the like. The rectangular construction utilizes repetitive structural members and hence a limited number of identical structural modules is used. The use of a central triangular module with side modules parallel to the sides of the platform provides major structural bulkheads for bearing the weight of the hull and the bending moments in the hull.

9 Claims, 5 Drawing Figures

FIG. 3
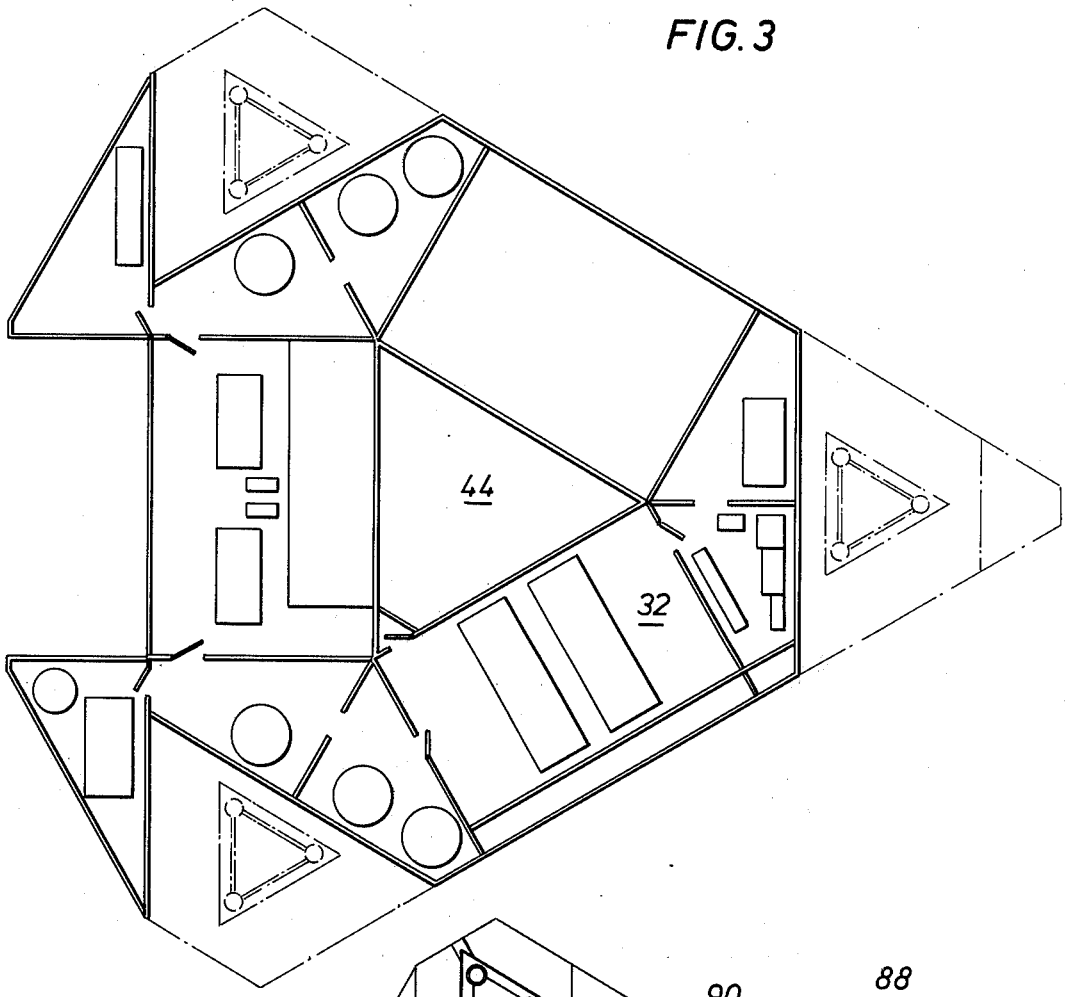
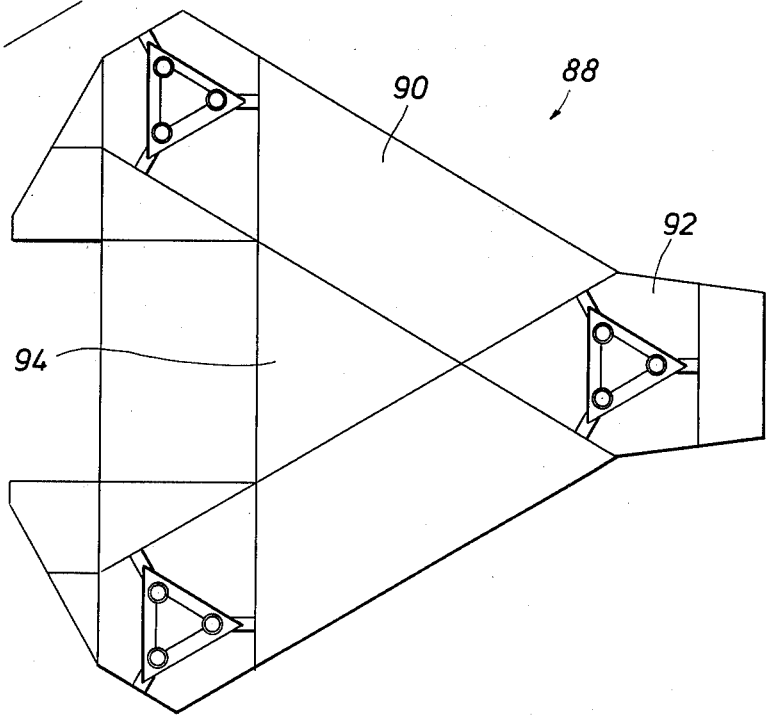
FIG. 4

HULL CONSTRUCTION

| Prior Art | | |
|---|---|---|
| 3,332,663 | 3,606,251 | 3,044,269 |
| 2,924,077 | 2,499,005 | 3,727,414 |
| 3,014,346 | 3,011,467 | 3,398,541 |
| 3,435,621 | 3,028,607 | 3,245,658 |
| 3,951,482 | 3,830,071 | 2,743,903 |

BACKGROUND OF THE INVENTION

In offshore drilling, three legged triangular hull constructions are quite common. These hull constructions have serious shortcomings because the major bulkheads and scantlings are arranged longitudinally and transversely with respect to the hull centerline. The procedure of framing hulls longitudinally and transversely is as old as shipbuilding itself and is the best method for framing ships and rectangular barges. However, when applied to triangular hulls the following problems are encountered:

A. Most major bulkheads and other structural members are of varying lengths and sizes with considerable variation of joint details where the members attach to each other.

B. Modular construction, which is widely used as a cost reducing method, is extremely difficult since there are few logical points at which the hull can be broken down into modules. In the event modular division is accomplished, the modules are of different sizes with varying scantlings.

C. The distribution of shear and moments throughout the hull girder is quite inefficient, due to the fact that these forces act along lines connecting the three legs. Thus the primary structures are, for the most part, running at a 30° angle with relation to the natural line of action of the forces acting on the hull. The results are that shear distribution among bulkheads is such that some have to be specially reinforced, and in some cases the addition of more bulkheads is required, while some carry practically no shear load. Plate stiffeners at some locations are skewed with relation to the bending moment acting on the hull such that their cross sectional areas cannot be included in overall hull girder strength, thus requiring thicker plating.

D. Compartments within the hull are of varying sizes and shapes. This poses difficulty in locating equipment within the hull and results in considerable unusable spaces. Watertight subdivision for stability purposes is very inefficient with additional bulkheads sometimes being added strictly for the purpose of obtaining proper satertight subdivison.

The hull of the present invention overcomes the problems noted above. By abandoning the conventional methods of framing and instead framing the hull in a direction consistent with the forces acting upon it, a new and greatly improved hull is realized which results in considerable weight savings and savings in labor cost during fabrication. It provides a modular construction consisting of a minimum number of modules of a minimum number of different sizes with modules of the same size being of identical construction. Further, the members comprising each module are of similar sizes and lengths. Special joint details are practically eliminated.

Bulkheads and plate stiffeners are arranged in the mot efficient manner for resistance of shear and moments acting on the hull girder. The bulkheads arrangement also represents the optimum watertight subdivision of the hull. Less structural material is required in the hull because the loads are distributed uniformly throughout the structural members, thus avoiding unduely loaded members that must be reinforced. In the most highly stresses parts, minimum reinforcing over the regular scantling requirements is added.

Size and configuration of machinery deck compartments accommodate placement of equipment in the most efficient manner resulting in the maximum utilization of all available space.

SUMMARY OF THE DISCLOSURE

The invention herein disclosed is summarized as a hull construction which incorporates a radical departure from the conventional framing methods and by doing so an improved hull construction is realized. This improved hull construction is distinguished by a centrally located triangular compartment with rectangular compartments adjacent to the sides of the central triangular compartment. At the three corners, leg wells are formed in the corner compartment. At the three corners, leg wells are formed in the corner compartments and leg raising equipment is included therein. The legs are preferably located equidistant from one another.

DESCRIPTION OF THE DRAWINGS

FIG. 3 is a view similar to FIG. 1 showing the preferred internal layout of the equipment within the hull;

FIG. 4 is a plan view of an alternative embodiment; and

DESCRIPTION OF THE PREFERRED EMBODIMENT

Figure 1:
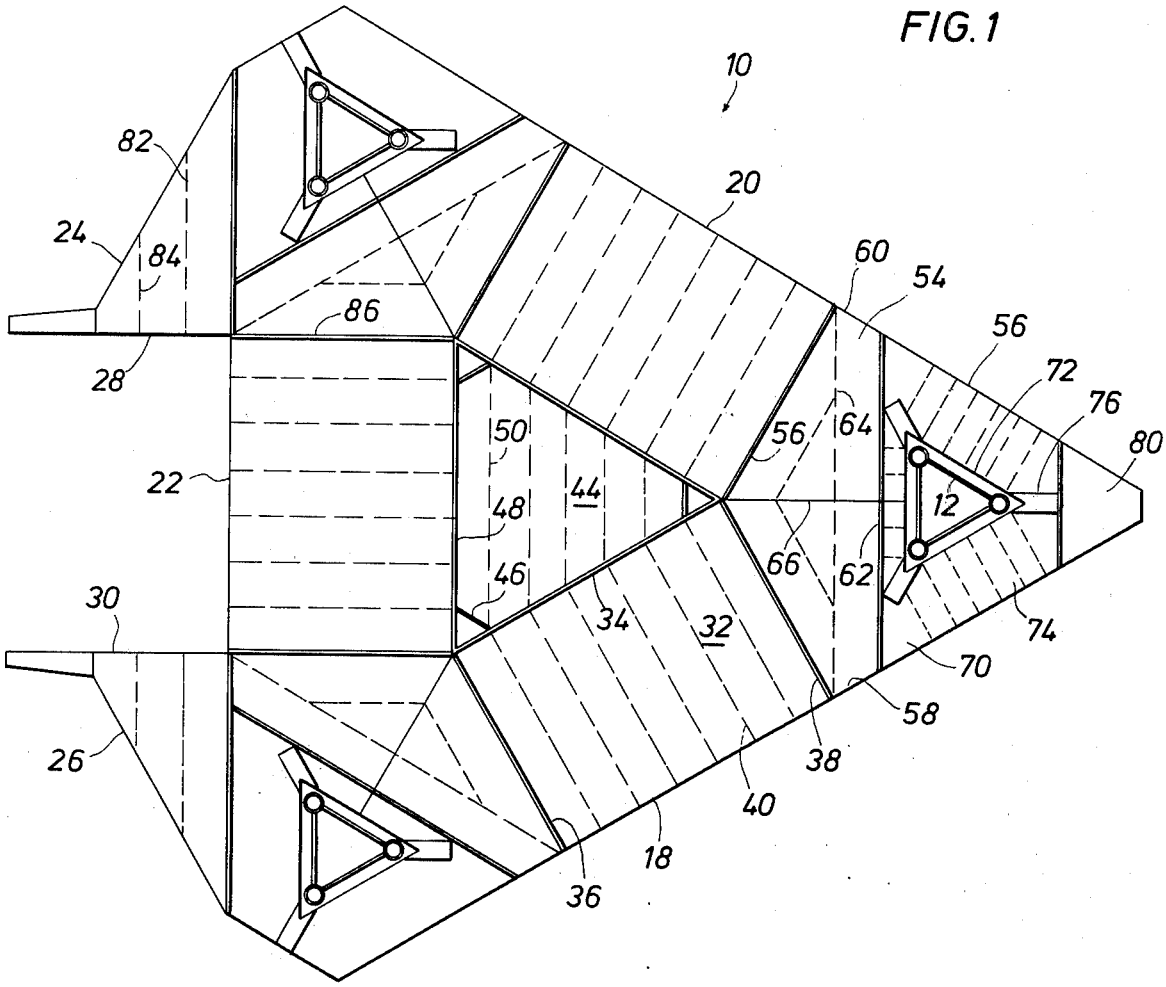
FIG. 1 is a plan view of the hull construction of the present invention showing structural members which define the structure.
Figure 2:
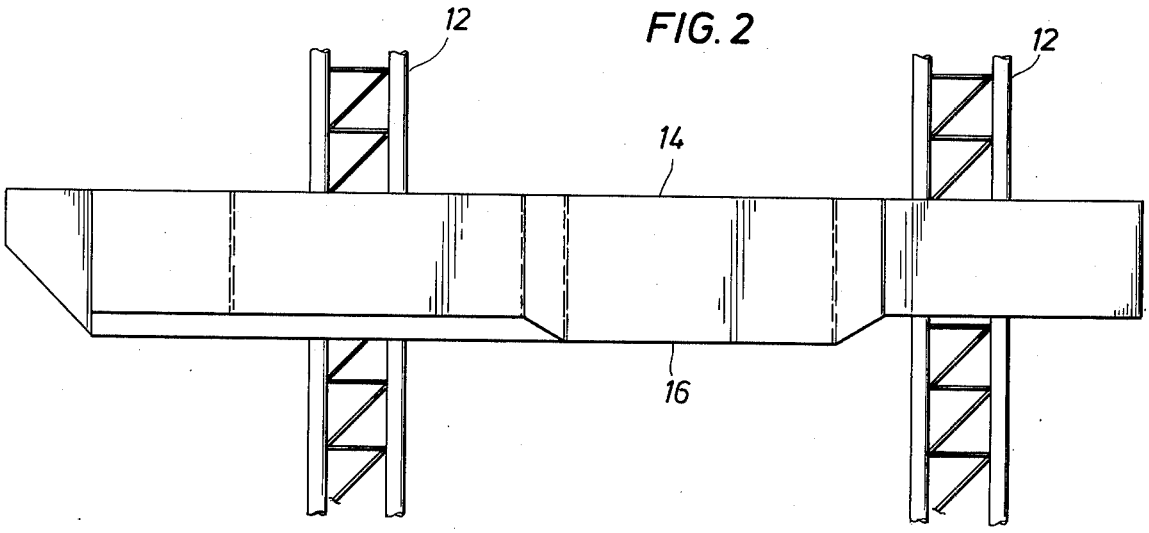
FIG. 2 is a side view of the hull of the present invention showing the hull supported on legs for elevation above the water level.

In FIG. 1, the improved hull of the present disclosure is identified by the numeral 10. It is a jack-up hull constructed with three equal sides. The sides will typically range up to about 200 feet in length. The hull typically will stand one or two stories tall and is otherwise adapted to be raised on legs 12 shown in FIG. 2. The three legs which raise the hull are preferably all identical to one another. The hull 10 is constructed with a top deck 14 and a bottom deck 16. Between the decks 14 and 16, the hull is constructed to define an interior of one or two stories in height.

The hull 10 is defined by a first side 18, a second side 20, and a third side 22. The sides 18 and 20 are clear of obstructions or protrusions. The side 22 is identical but there is included a first cantilevered section 24 at one end and a similar cantilevered section 26 at the other end. The sections 24 and 26 have facing edges 28 and 30 respectively which define a rectangular well so that the drilling rig itself is cantilevered between the protrusions and is able to drill clear of the hull. This places the derrick and associated equipment towards one side to leave a clear area towards the center of the equipment for storage of pipe, and so on. The protruding cantilevered portions 24 and 26 are relatively small in total size in comparison with the remainder of the rig. They do not destroy the symmetry which is found in the rig but rather, they assist in location of the drilling equipment to one side so that the center portions can be maintained clear. In an alternative construction these members could be eliminated, with the derrick and associated equipment cantilevered over the side of the platform by means of cantilevered girders resting on the top deck. It is not essential that the derrick and drilling equipment be pushed to the side but rather, they can be located toward the center so that the well is drilled from a central location by placing the drill string through a conductor pipe extending through the hull 10.

The outside walls 18, 20 and 22 are substantial in length. The central portions thereof ranging from 40 to 60% of the length define edges of rectangular compartments. The compartment 32 will be described, the other compartments being identical in construction. The identical nature of the several compartments is one of the significant advances of the present disclosure. The compartment 32 has an external side wall common with the edge 18 of the rig. An internal wall 34 is parallel to the wall 18. The walls 18 and 34 are intersected by transverse end walls 36 and 38. They are parallel to one another. They define the ends of the rectangular compartment 32. The space between the end walls 36 and 38 is supported by a number of parallel transverse beams 40 that in turn support a number of parallel, similar stiffeners. The beams 40 define evenly spaced reinforcing members. They are all preferably identical to one another. They are preferably located in the floor and in the ceiling of the compartment 32.

The compartment 32 is thus defined with an open interior and has a bottom, ceiling, and four vertical walls. The structural members which define these four walls, bottom and ceiling are regularly spaced, positioned at right angles to another, and are uniformly stiffened. This enables the construction of the rectangular compartment 32 with the maximum economies in materials and labor. It will be observed that three identical compartments are included. They are constructed identically other than interior furnishings. This permits them to be constructed in modular fashion. Moreover, it enables the use of common jigs and templates to achieve the construction in a fashion not ordinarily obtained. As a consequence, the hull is quickly and economically assembled.

The three side compartments are abutted with one another and define a central triangular compartment 44. The center compartment 44 is thus defined by the three abutting walls positioned against it. One of the three walls is selected as a reference and a set of parallel transverse structural members 50 evenly spaced define the central compartment 44. The structural members 50 are again located in the bottom and the ceiling. The central triangular compartment 44 thus has a common bottom and ceiling with the side compartments. It is formed of regularly spaced structural members.

The apparatus includes corner compartments. The corner compartments are defined by a pentagon-shaped compartment or module 54 and a trapezoidal compartment 56. The adjacent side compartments define an included angle of about 120°. The pentagon shaped compartment is fitted against it. It thus has in common side walls 38 and 56. It incorporates edge wall portions 58 and 60. The fifth wall is found at 62. The pentagon compartment includes structural reinforcing at 64 which is parallel to the longest wall thereof and is transversely braced at 66. As will be observed, it is symmetrically constructed. The fifth wall 62 abutts and adjoins the leg well compartment which is located in the corner. The leg well compartment at the corner carries a substantial load to support the hull 10 on the leg 12 which passes through the compartment. The corner compartment is thus identified by the numeral 70 and includes a triangular opening 72 in the center. The triangular opening is defined by two sides which are parallel with the sides 18 and 20 of the hull. Between the parallel sides, a number of evenly spaced structural reinforcing members 74 are placed. The number is substantial, and they are of substantial strength. They provide a means whereby the forces acting on the hull weight are transferred to the leg 12.

The leg 12 is supported by leg elevating machinery 76. Preferably, three sets are included so that each corner of the triangular leg is engaged. The leg elevating machinery is anchored to the hull through the top deck. The hull itself, being structurally reinforced, distributes the stresses into the structural members including members 74.

The corner compartment 70 cooperates with the five sided compartment 54 to fill the corner of the triangular platform. The actual corner itself is included at 80 although this may be truncated and thereby omitted. It does not provide any structural strength but it does provide bouyancy when afloat or pre-loading when erected. The bulkhead 62 defines the limits of the useful work area in the structure. The bulkhead 62 also serves as a divisional bulkhead to isolate the work areas of the platform from the hull-leg connection area. This is a safety feature because this area is the area most likely to suffer damage in a storm. Towards the interior of the hull 10 from the bulkhead 62, the various compartments for personnel, equipment, and the like are defined. On the other side of the bulkhead 62, the pre-loading tank is found.

The appended compartment 24 and 26 are similarly constructed and have internal structural framing members 82 and 84. They join to a common wall 28 which is an extension of the wall 86 of the adjacent side compartment.

In FIG. 3 of the drawings, a suitable application of the various compartments is illustrated. As an example, the central triangular compartment 44 can be used as a storage tank. The tank is perfect for pre-loading water storage. The mud tanks can be placed in the compartment 32. All of the machinery can be located in one side compartment and the remaining side compartment is used as crew quarters. The three five sided corner compartments are used for various and sundry work areas including galley, refrigerator, storage areas, drilling additives in tanks, and the like. Even the appended compartments 24 and 26 can be used as work areas for speciality equipment such as logging equipment, drilling interpretation equipment, geologists work area and the like.

The size and configuration of the compartments as related to placement of equipment should be noted as they represent one of the greater advantages of this invention.

As will be observed on viewing FIG. 3, the three compartments where the leg wells are included are not accessable to the crew. This is a safety feature. The leg elevating machinery is isolated from the crew quarters by locating it at the corners of the deck.

The central triangular compartment 44 and the three side compartments which define it are all of modular construction. They go together easily and are defined by right angle corners, at least insofar as the construction of the side compartments. After construction of the side compartments, little remains to be done in the triangular compartments other than to provide the set of parallel transverse reinforcing members 50. Once the three side compartments have been joined, the five sided compartments are added. This completes accessible areas. The compartments are again of identical framing and are constructed in modular fashion. Lastly, the three leg well compartments are attached. The last compartments to be added are the appended compartments 24 and 26. They are symmetrical to one another. As will be observed, the total number of modules is minimized and the ones that are included are similar to one another and they are assembled with a substantial savings in assembly time and construction costs.

The structural members are arranged in the most efficient manner for resistance of shar moments acting on the hull girder. The structural arrangement also represents the optimum wateritght subdivision of the hull for stability purposes. The shear loads are distributed uniformly throughout the structural members thus avoiding highly loaded members that must be specially reinforced. This is accomplished by arranging the structural bulkheads at the leg wells in a symmetrical fashion, assuring that shear loads from the leg well areas will be distributed equally. Also, the major bulkheads in the main body 18, 34 and 48 are positioned to support approximately equal portions of the hull and equipment weight. Plate stiffeners are arranged to run parallel to the natural line of action of the bending moments acting on the hull, i.e., between the legs. This allows their cross sectional area to be included in overall hull girder strength for all storm approach directions.

The bending moments thus act parallel to the sides of the drilling rig and the construction of the compartments is such that their major structural members directly accommodate the bending moments.

As a consequence, less material is required in the hull, even in the most highly stressed areas very little increase is required over the sizes required for local hydrostatic head.

Figure 5:
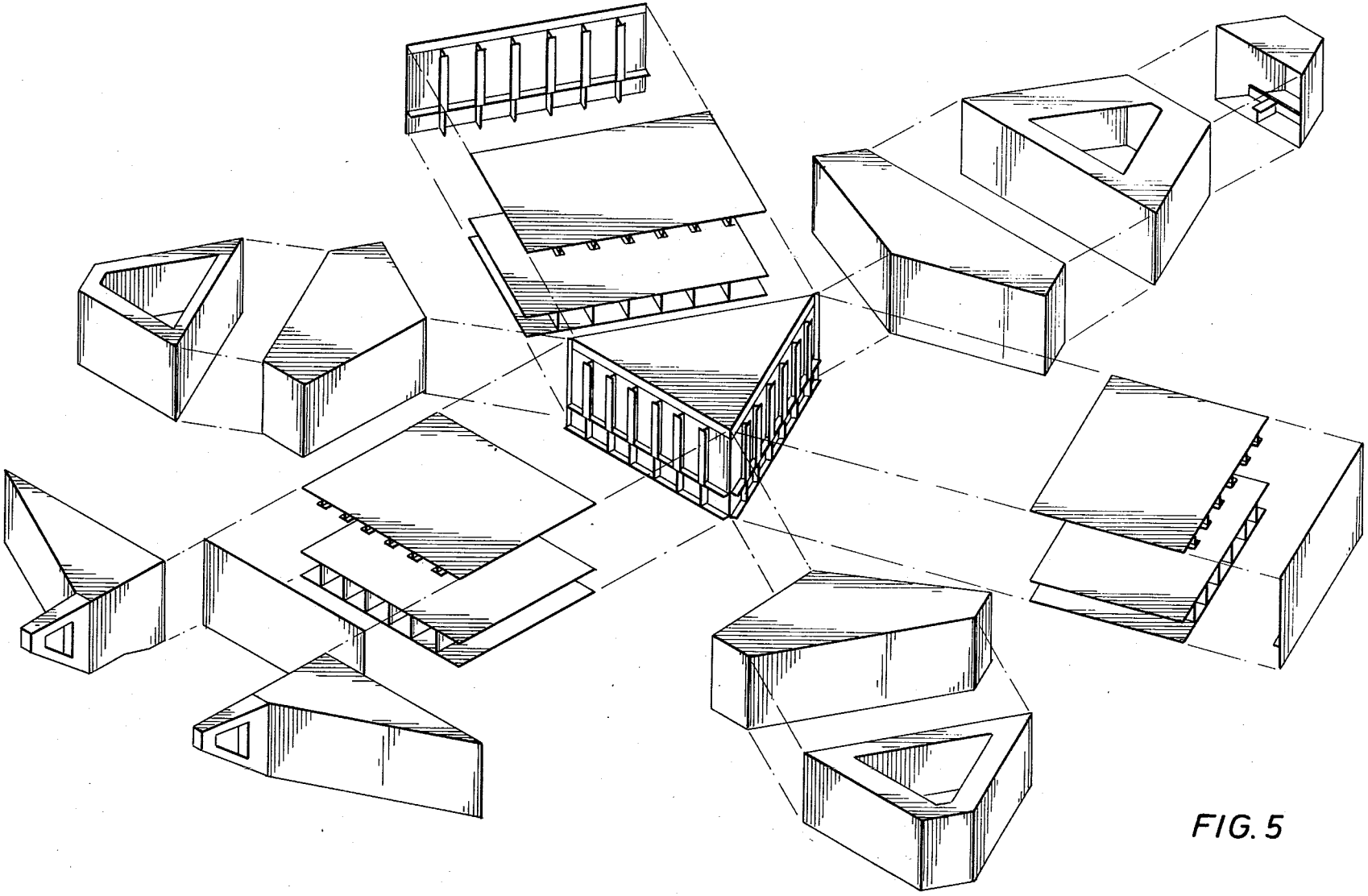
FIG. 5 is an exploded view of the hull of FIG. 1.

FIG. 5 shows the various modules and how they bit together.

The hull 10 has a bottom preferably profiled to enable the leg 12 to be raised until the foot of the leg is nested in the indented area. The hull shape is otherwise normally uniform between the top and bottom.

The hull 10 is normally raised on the legs 12 by lowering the legs until they contact the bottom. When they touch, they must thereafter by tested to avoid sudden penetration of the leg into the sea bed after the hull has been raised. It has been discovered that the a very good test of the footing of the legs 12 on the bottom is to elevate the hull 10 until it is about five feet above the water level. The entire weight of the hull is on the legs. The present invention then is pre-loaded to correspond to the loads encountered in a storm. The weight of the hull is increased by filling tanks with sea water until a desired weight is added to the hull. The water is stored in the compartment 44 and the corner compartments 70. This results in the necessary weight increase for preloading the legs as a safety precaution.

Typically, the pre-load test can add a specified portion of the weight of the hull 10 by filling these compartments with water. The test can be short or long, as desired. When the test is over, the water is dumped and the compartments are emptied. The pre-loading test is then over, giving assurance that the jack up rig can ride out storms with a substantial degree of safety.

In FIG. 4 of the drawings, the numeral 88 identifies an alternative modular hull construction in accordance with the teachings of the present invention. It is similar to the construction shown in FIG. 1. It has a reduced number of modular compartments. In particular, it has a three side compartments 90 which are idenical to one another and which are trapezoidal in shape. The side compartments 90 are grouped around a central triangular compartment 94. The compartment 94 is identical to the compartment 44 shown in FIG. 1. The side compartments 90 are constructed of lengthwise and transverse framing members. They include load bearing bulkheads extending along the major dimension thereof. In this sense they are identical to the side compartments shown in FIG. 1. They differ only in the connection at the corners and there, a five sided corner module 92 is provided.

The embodiment 88 thus handles the bending moments which run parallel to the sides of the platform from leg to leg by constructing the side compartments of framing members which are parallel and transverse to these bending moments. This enables the embodiment 88 to handle the bending moments. The bending moments thus are parallel to the side of the drilling rig and the construction of the side compartments of major structural members extending parallel to the sides directly accommodates the bending moments.

The embodiment of FIG. 4 is easily built in that it includes a few modules. In construction, the embodiments disclosed herein are built with reduced labor and material cost. There is a reduction in the number of templates required. The bending moments are handled better than in hulls of the prior art which were constructed on traditionally longitudinal and transverse patterns aligned with the major axis of the vessel.

The present invention thus utilizes a construction technique which is particularly suited for triangular shaped hulls of jackup platforms. In particular, the stiffening of bottom, top, and intermediate decks runs parallel to the outer side of the triangular hull and adequate strength is more easily accomplished with regular distribution of forces in the hull between the legs. The internal bulkheads obtained by the compartmentalization taught herein are appropriately located to be of assistance in the distribution of shear forces in the hull. The modular hull with maximum repetition of structural members greatly expedites hull construction. As a consequence, for a given size hull, the present invention reduces hull construction cost, weight and labor. All of this is accomplished at no sacrifice in strength. Moreover, the hull interior is appropriately divided into logically defined compartments.

The foregoing is directed to the preferred embodiment but the scope thereof is determined by the claims which follow.

I claim:

1. An improved jack up drilling rig construction which comprises an enclosed hull having three wells for receiving a set of supportive legs therethrough which legs support the weight of said hull when said hull is elevated on said legs above a body of water;

said leg wells being equally spaced from one another and said hull having first, second and third edge located sides extending between and near said leg wells;

symetrically constructed side compartments in said hull which are arranged adjacent to the edges of said hull which side compartments define by a common side a centrally located triangular compartment;

said side compartments having lengthwise members parallel to the edges of said hull for supporting the bending movements acting parallel to the edges of said hull; and three corner located compartments incorporating said leg wells therein, said corner located compartments being positioned symetrically of said hull and each supporting a leg elevating means.

2. The hull construction of Claim 1 wherein said side compartments have a longer dimension adjacent to the exterior edge of said hull, said side compartments having a shorter dimension at right angles to said longer dimension, and they are rectangular.

3. The hull construction of Claim 1 wherein said central compartment has sides in common with said side compartments.

4. The hull construction of claim 3 wherein central compartment is constructed and arranged of structural members parallel to one side thereof.

5. The hull construction of Claim 1 wherein said corner compartments include vertical leg wells therein, said leg wells encircling the legs on insertion therethrough.

6. The apparatus of claim 1 wherein said side compartments extend the full length of the edges of said centrally located triangular compartment, and said side compartments are rectangular in shape.

7. The apparatus of claim 1 wherein said side compartments extend the full length of the edge of said centrally located triangular compartment, and said side compartments are trapozoidal.

8. The hull construction of claim 6 wherein said side compartments have a longer dimension adjacent to the exterior edge of said hull, said side compartments having a shorter dimension at right angles to said longer dimension, and they are rectangular.

9. The hull construction of claim 7 wherein said side compartments have a longer dimension adjacent to the exterior edge of said hull, said side compartments having a shorter dimension at right angles to said longer dimension, and they are rectangular.

* * * * *